US008792657B2

(12) United States Patent
Suzuki et al.

(10) Patent No.: US 8,792,657 B2
(45) Date of Patent: Jul. 29, 2014

(54) SPEAKER DEVICE

(75) Inventors: Nobukazu Suzuki, Kanagawa (JP); Yoshio Ohashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 307 days.

(21) Appl. No.: 12/769,132

(22) Filed: Apr. 28, 2010

(65) Prior Publication Data

US 2010/0284555 A1 Nov. 11, 2010

(30) Foreign Application Priority Data

May 11, 2009 (JP) ..... P2009-114119

(51) Int. Cl.
*H04R 25/00* (2006.01)

(52) U.S. Cl.
USPC ..... 381/162; 381/150; 381/152; 381/191

(58) Field of Classification Search
CPC ..... H04R 7/045; H04R 9/066; H04R 17/00; H04R 17/005; H04R 2499/15; H04R 1/025; H04R 11/00; H04R 11/02; H04R 19/00; H04R 19/02
USPC ..... 381/111–117, 150, 162, 337–354, 381/182–186, 190–191, 396–432, 152; 181/157, 167–174, 148, 161
See application file for complete search history.

(56) References Cited

U.S. PATENT DOCUMENTS

| | | | | |
|---|---|---|---|---|
| 4,322,583 | A * | 3/1982 | Maeda | 381/425 |
| 4,473,721 | A * | 9/1984 | Klein | 381/190 |
| 4,567,327 | A * | 1/1986 | Goossens et al. | 381/185 |
| 5,727,076 | A * | 3/1998 | Paddock | 381/190 |
| 2002/0191807 | A1 * | 12/2002 | Asada et al. | 381/335 |
| 2007/0133837 | A1 | 6/2007 | Suzuki et al. | |
| 2009/0060253 | A1 * | 3/2009 | Imamura et al. | 381/407 |

FOREIGN PATENT DOCUMENTS

JP 2007-166027 6/2007

OTHER PUBLICATIONS

U.S. Appl. No. 13/400,979, filed Feb. 21, 2012, Suzuki, et al.
U.S. Appl. No. 13/381,551, Dec. 29, 2011, Suzuki, et al.

* cited by examiner

*Primary Examiner* — Xu Mei
(74) *Attorney, Agent, or Firm* — Oblon, Spivak, McClelland, Maier & Neustadt, L.L.P.

(57) ABSTRACT

A speaker device includes: an acoustic diaphragm; a vibration transfer member provided in a state of touching the acoustic diaphragm over a given length, which is configured to transfer vibration to the acoustic diaphragm; and an actuator configured to add vibration corresponding to an audio signal to be reproduced to the vibration transfer member to thereby transfer vibration to the acoustic diaphragm through the vibration transfer member and to generate sound.

19 Claims, 12 Drawing Sheets

<UPPER SURFACE>

<SIDE SECTION>

SPEAKER DEVICE

BACKGROUND OF THE INVENTION

1. Field of the Invention

The present invention relates to a speaker device having an excitation-type structure in which sound is generated by transferring vibration corresponding to an audio signal generated by an actuator such as a giant magnetostrictive actuator to an acoustic diaphragm.

2. Description of the Related Art

A speaker device in which sound is generated by adding vibration to an acoustic diaphragm made of acrylic and the like by an actuator such as a giant magnetostrictive actuator has been invented and has been in practical use, instead of a normal speaker unit having a voice coil and a cone.

Specifically, in JP-A-2007-166027 (Patent Document 1), there is disclosed a device in which a cylindrical acoustic diaphragm is vertically supported, plural magnetostrictive actuators are arranged at a lower end side of the acoustic diaphragm and drive rods of respective magnetostrictive actuators are allowed to abut on a lower end surface of the acoustic diaphragm to add vibration in the axial direction to the acoustic diaphragm.

In the above speaker device, first, the end surface of the cylindrical diaphragm is excited, thereby allowing a compression wave in the longitudinal direction of the cylinder at once. In a process in which the compression wave propagates, force is generated in the radial direction of the cylinder (direction orthogonal to the longitudinal direction of the cylinder) by Poisson's ratio included in a solid. The vibration occurs in the radial direction by the force, as a result, sound waves are generated from the entire cylindrical diaphragm.

Here, Poisson's ratio means the radio between expansion or contract in the direction of force generated when an elastic body is expanded or contracted and expansion or contract in the vertical direction which is the direction orthogonal to the direction of force.

In the speaker device, sound waves are radiated at any position in the axial direction of the acoustic diaphragm in a uniform level and a uniform sound image is formed all over the height (longitudinal) direction of the acoustic diaphragm. That is, a high quality reproduced sound field can be realized.

SUMMARY OF THE INVENTION

The excitation-type speaker device disclosed in the above Patent Document 1 has basically the structure in which the sound is generated by exciting one acoustic diaphragm by actuators.

In the above structure, transfer characteristics of the compression wave of the acoustic diaphragm are determined depending on materials, thickness and so on of the acoustic diaphragm, therefore, a frequency band which can be covered will be limited to a certain degree when it is desired to expand the frequency band.

Additionally, in the case of the excitation-type speaker device disclosed in the above Patent Document 1, the compression wave is not efficiently transferred unless the acoustic diaphragm has a certain degree of thickness. Accordingly, when the acoustic diaphragm made of a thin material is used for the excitation-type speaker device, it is difficult to allow vibration to propagate (be transferred) all over the acoustic diaphragm, as a result, it is likely that a good reproduced sound field is not formed.

Thus, it is desirable to cover a wider frequency band as well as to use acoustic diaphragms having various materials and thicknesses even in a so-called excitation-type speaker device using an actuator.

According to an embodiment of the invention, there is provided a speaker device including an acoustic diaphragm, a vibration transfer member provided in a state of touching the acoustic diaphragm over a given length, which is configured to transfer vibration to the acoustic diaphragm, and an actuator configured to add vibration corresponding to an audio signal to be reproduced to the vibration transfer member to thereby transfer vibration to the acoustic diaphragm through the vibration transfer member and to generate sound.

In the speaker device according to the embodiment of the invention, the vibration transfer member is provided in a state of touching the acoustic diaphragm over a given length, and vibration corresponding to the audio to be reproduced is added by the actuator to the vibration transfer member.

According to the above, vibration can be efficiently transferred to the acoustic diaphragm through the vibration transfer member, therefore, transfer efficiency (propagation efficiency) of vibration is improved and a wider frequency band will be covered as compared with a case of exciting the acoustic diaphragm directly. Additionally, transfer efficiency of vibration to the acoustic diaphragm is improved, thereby widening the selection range of the acoustic diaphragm concerning materials, thickness and the like.

According to the embodiment of the invention, in a so-called excitation-type speaker device using an actuator, transfer efficiency of vibration to the acoustic diaphragm can be improved and a wider frequency band can be covered. Also, the transfer efficiency of vibration to the acoustic diaphragm is improved, thereby widening the selection range of the acoustic diaphragm concerning materials, thickness and the like.

DESCRIPTION OF THE PREFERRED EMBODIMENTS

Hereinafter, a speaker device according to an embodiment of the invention will be explained with reference to the drawings.

[Basic Structure of an Excitation-Type Speaker Device Explained in the Embodiment]

Figure 1:
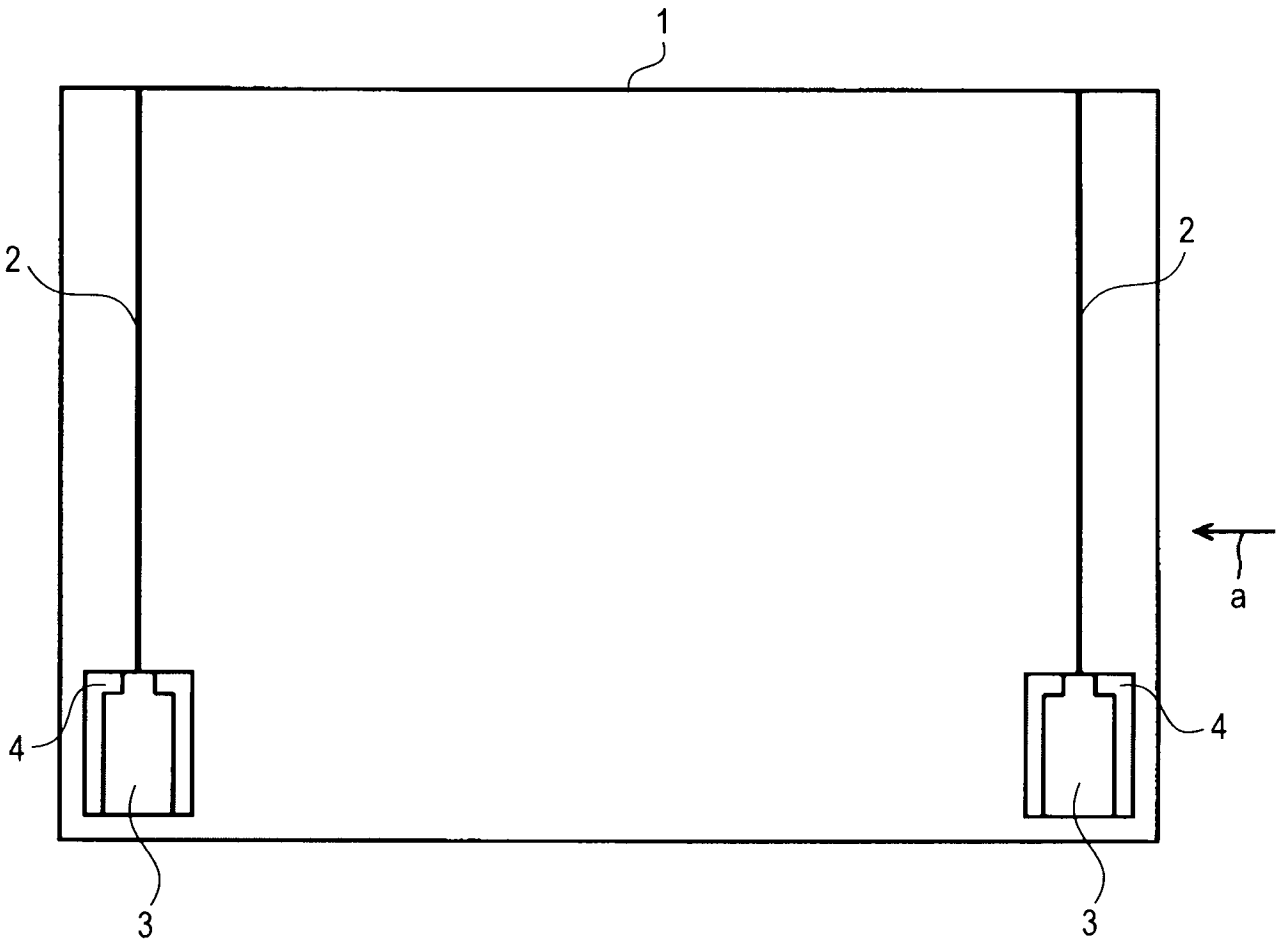
FIG. 1 is a view for explaining an excitation-type speaker device to which an embodiment of the invention is applied.

FIG. 1 is a view for explaining an excitation-type speaker device to which an embodiment of the invention is applied.

As shown in FIG. 1, the speaker device according to the embodiment includes an acoustic diaphragm 1, vibration transfer members 2 provided at the left side and the right side of the acoustic diaphragm 1 respectively and actuators 3.

The acoustic diaphragm 1 is made of, for example, an acrylic plate and has a thickness of, for example, 2 to 3 mm and a size of approximately 30 cm (length)×40 cm (breadth) in the embodiment. Needless to say, this is an example and the thickness or the size can be varied. The acoustic diaphragm 1 can be made of other various materials such as organic glass, in addition to the acrylic plate.

The vibration transfer member 2 is made of, for example, carbon fiber and carbon nano-fiber, which is formed to have a stick shape (wire shape) having approximately 1 mm to several mm in diameter in the embodiment. The vibration transfer member 2 is fixed in a state of touching the acoustic diaphragm 1.

The vibration transfer member 2 is formed to have a stick shape as described above, however, the shape of which can be variously changed, for example, a cylindrical shape, a prismatic shape and a plate shape. That is, the vibration transfer member 2 is formed to have a stick shape, but the shape of the cross section can be various shapes, for example, a circular shape, a semi-circular shape and a rectangular shape.

The vibration transfer member 2 can be fixed to the acoustic diaphragm 1 by various methods such as adhesion by an adhesive or an adhesive tape, fusion bonding by heating or embedding to the acoustic diaphragm 1. The method of fixing is not so important here, and it is important that the vibration transfer member 2 is provided in a state of touching the acoustic diaphragm 1 over a given length.

The vibration transfer member 2 can use members made of other materials, for example, a piano wire made of steel, not limited to carbon fiber. That is, it is necessary for the vibration transfer member 2 to use materials having low "internal loss" as well as high "sound velocity" such as carbon fiber or steel materials.

Here, the "internal loss" literally means the loss occurring when vibration propagates in a solid, in other words, it means that whether vibration easily propagates or not. Therefore, when the "internal loss" is low, it means that propagation loss is low, namely, "vibration efficiently propagates". The "sound velocity" means transfer velocity of an elastic wave propagating in an elastic body or a continuum.

When focusing attention to the "internal loss" and the "sound velocity", it is necessary for the most desirable material (ingredient) as the vibration transfer member 2 to have excellent vibration propagating efficiency, therefore, the material having low "internal loss" is desirable in the first place.

Furthermore, it is necessary that the material has high "sound velocity" for allowing time delay between a start point (excitation point) to an end point (place most distant from the excitation point) of the vibration transfer member 2 to be minimum.

Accordingly, it is preferable that a suitable member as the vibration transfer member 2 is selected and used based on the "internal loss" and the "sound velocity". Specifically, various materials having lower "internal loss" and higher "sound velocity" as compared with the acoustic diaphragm 1 are preferably used.

The vibration transfer member 2 is provided so that an end thereof is exposed at an upper end of a square hole portion which is provided at the acoustic diaphragm 1 for mounting the actuator 3 thereon.

Accordingly, when the actuator 3 is mounted to a square hole portion 4 of the acoustic diaphragm 1, an end of the vibration transfer member 2 exposed at the upper end of the square hole portion 4 can be excited by a rod (excitation portion) of the actuator 3.

Configuration Example of an Actuator

Here, a structure example of the actuator 3 used in the speaker device according to the embodiment will be explained. In the speaker device according to the embodiment, various types of actuators such as a piezoelectric actuator, an electromotive actuator and a giant magnetostrictive actuator can be used.

The piezoelectric actuator uses an element making a displacement by applying voltage. The electromotive actuator generates vibration with a coil and a magnet by using electric current. The giant magnetostrictive actuator uses a giant magnetostrictive element in which the element size varies according to a magnetic field from the outside.

Figure 2A:
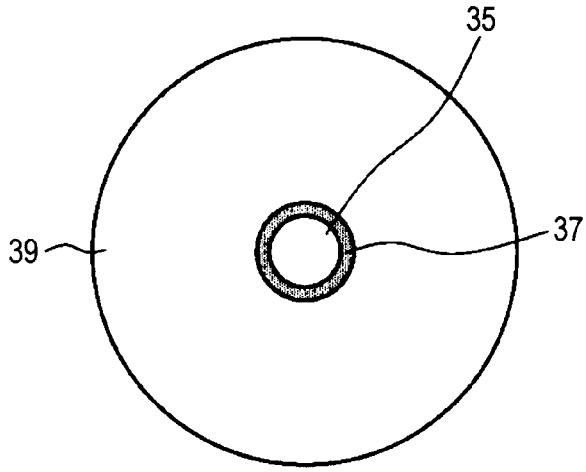
FIG. 2A and FIG. 2B are views for explaining a structure example of an actuator used in the speaker device according to the embodiment.
Figure 2B:
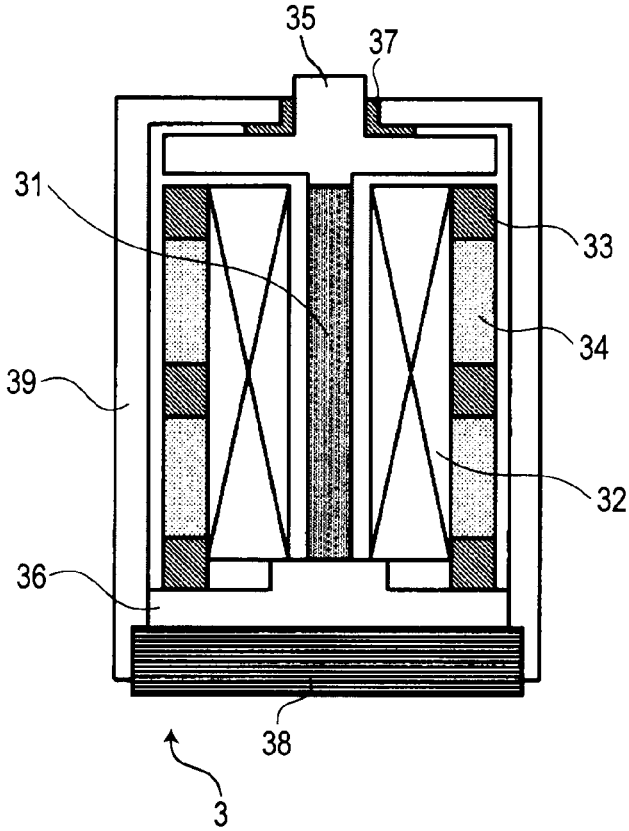

In this case, a structure example of the giant magnetostrictive actuator as one of usable actuators will be explained. FIG. 2A and FIG. 2B are views for explaining a structure example of a giant magnetostrictive actuator 3 used for the speaker device according to the embodiment. The example shows a case in which preload is added to the giant magnetostrictive element, in which FIG. 2A is an upper surface view and FIG. 2B is a sectional side view.

In the actuator body, a solenoid coil 32 is arranged around a stick-shaped giant magnetostrictive element 31, and a magnet 33 and a yoke 34 are arranged around the solenoid coil 32.

Furthermore, a drive rod 35 is connected to one end of the giant magnetostrictive element 31, and a fixed plate 36 is attached to the other end of the giant magnetostrictive element 31.

The actuator body is loaded into an outer casing 39 made of, for example, aluminum so that a tip portion of the drive rod 35 protrudes from the outer casing 39.

Moreover, a damping material 37 made of silicon rubber is loaded in the drive rod 35 and a screw 38 is inserted to the back of the fixed plate 36 to add preload to the giant magnetostrictive element 31.

In the speaker device shown in FIG. 1, the actuator 3 having the structure shown in FIG. 2A and FIG. 2B is mounted to the square hole portion 4 of the acoustic diaphragm 1 to be fixed thereto.

In this case, it is preferable to obtain magnetostrictive characteristics in which a magnetic field range in which a magnetostrictive value changes linearly with respect to change of a control magnet field is wide as well as change of the magnetostrictive value with respect to the change of the control magnetic field within the magnetic field range is large. For example, the load to the giant magnetostrictive element 31 can be adjusted by compressing a coil spring and the like arranged below the actuator 3.

[Operations of the Speaker Device in the Embodiment]

When drive current corresponding to an audio signal is supplied to the solenoid coil 32 of the actuator 3 having the above structure, the giant magnetostrictive element 31 expands and contracts due to effects of the magnetic field generated in response to the supply.

Accordingly, the drive rod 35 of the actuator 3 moves upward and downward and the end portion of the vibration transfer member 2 is tapped by the drive rod 35 as shown in FIG. 1. Accordingly, vibration corresponding to the audio signal is added to the vibration transfer member 2 provided in a state of touching the acoustic diaphragm 1, not to the acoustic diaphragm 1.

The vibration transfer member 2 is a stick shaped member made of carbon fiber as described above, which has low "internal loss" as well as high "sound velocity" as compared with the acoustic diaphragm 1 as the acrylic plate.

Accordingly, one end of the vibration transfer member 2 is excited, which allows vibration to propagate through the vibration transfer member 2 efficiently and to reach the other end of the vibration transfer member 2.

Since the vibration transfer member 2 is provided in a state of touching the acoustic diaphragm 1, the vibration added by the actuator 3 can be transferred to the acoustic diaphragm 1 efficiently as compared with a case in which the acoustic diaphragm 1 is excited directly.

Accordingly, the compression wave propagates efficiently through the acoustic diaphragm 1, and the acoustic diaphragm 1 vibrates due to excitation by the actuator 3 more suitably, thereby widening the frequency band of audio generated by the acoustic diaphragm 1.

[Time Difference of Audio Discharge from the Acoustic Diaphragm 1]

When sound velocity from the vibration transfer member 2 is faster than sound velocity of the acoustic diaphragm 1, time difference of audio discharge in the excitation axis direction discharged from the acoustic diaphragm 1 can be reduced. The time difference of audio discharge will be specifically explained.

Figure 3:
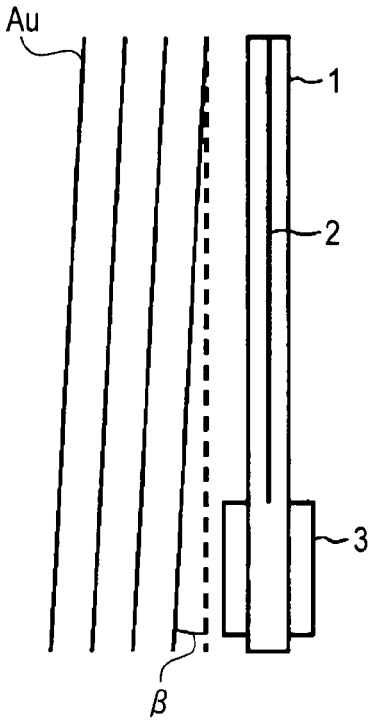
FIG. 3 is a view for explaining the time difference of audio discharged from the speaker device to which an embodiment of the invention is applied.
Figure 4:
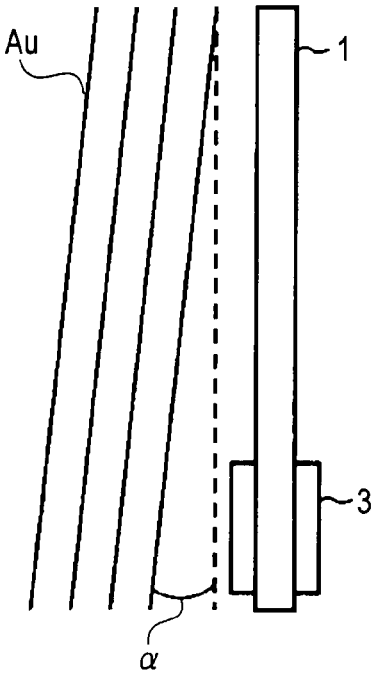
FIG. 4 is a view for explaining the time difference of audio discharged from an excitation-type speaker device in the case of not using the vibration transfer member.

FIG. 3 and FIG. 4 are views for explaining the time difference of audio discharge in the excitation axis direction discharged from the acoustic diaphragm 1. FIG. 3 concerns the speaker device according to the embodiment which uses the vibration transfer member 2. FIG. 4 concerns the speaker device not using the vibration transfer member 2.

FIG. 3 is a view of the speaker device shown in FIG. 1, which is seen from the side surface as shown by an arrow "a" in FIG. 1. As shown in FIG. 3, the vibration transfer member 2 is buried inside the acoustic diaphragm 1. Therefore, the entire periphery of the vibration transfer member 2 is in a state of touching the acoustic diaphragm 1.

In FIG. 3, a surface indicated by a dotted line is a surface parallel to the acoustic diaphragm 1 and a surface indicated by a solid line is a sound wave surface Au of audio discharged from the acoustic diaphragm 1.

In the speaker device configured as shown in FIG. 3, when the vibration transfer member 2 is excited by the actuator 3, the vibration is rapidly transferred to the entire acoustic diaphragm 1 through the vibration transfer member 2.

In this case, at a lower portion of the acoustic diaphragm 1 in the vicinity of the actuator 3, transfer of vibration is fast as it is close to the actuator 3, therefore, audio is discharged slightly faster there than at an upper portion of the acoustic diaphragm 1.

However, the vibration excited by the actuator 3 is rapidly transferred also to the upper portion of the acoustic diaphragm 1 through the vibration transfer member 2, therefore, the time difference of audio discharge between the lower portion and a reception side portion in the acoustic diaphragm 1 can be reduced.

Specifically, as shown in FIG. 3, an angle $\beta$ between the surface parallel to the acoustic diaphragm 1 which is shown by the dotted line and the sound wave surface Au of audio discharged from the acoustic diaphragm 1 shown by the solid line can be reduced.

On the other hand, the excitation-type speaker device not using the vibration transfer member 2 as shown in FIG. 4 is examined. Also in FIG. 4, a surface indicated by a dotted line is a surface parallel to the acoustic diaphragm 1 and a surface indicated by a solid line is a sound wave surface Au of audio discharged from the acoustic diaphragm 1.

In the case of the excitation-type speaker device not using the vibration transfer member 2 shown in FIG. 4, it takes time until vibration given by the actuator 3 is transferred to the upper portion of the acoustic diaphragm 1 because there does not exist the vibration transfer member 2.

Accordingly, as shown in FIG. 4, an angle $\alpha$ between the surface parallel to the acoustic diaphragm 1 shown by the dotted line and the sound wave surface Au of audio discharged from the acoustic diaphragm 1 shown by the solid line is larger than the angle $\beta$ shown in FIG. 3.

As can be seen from comparison between FIG. 3 and FIG. 4, when the vibration transfer member 2 is allowed to touch the acoustic diaphragm 1 and the vibration transfer member 2 is excited by the actuator 3, vibration can be rapidly transferred to the entire acoustic diaphragm 1 as compared with the case in which the acoustic diaphragm 1 is excited directly.

As described above, it is possible to add vibration corresponding to audio to the entire acoustic diaphragm 1 without time delay through the vibration transfer member 2 by using the vibration transfer member 2 made of the material having low "internal loss" as well as high "sound velocity" as compared with the acoustic diaphragm 1.

Accordingly, the acoustic diaphragm 1 can be vibrated efficiently, therefore, it is possible to widen the frequency band of sound (audio) discharged by vibrating the acoustic diaphragm 1 and to form a better reproduced sound field. In other words, the sound image can be oriented itself to the entire acoustic diaphragm 1 more properly through the vibration transfer member 2, and a better reproduced sound field can be formed.

[Contact Length of the Vibration Transfer Member 2 with Respect to the Acoustic Diaphragm 1]

In the case of the speaker device according to the above embodiment, the acoustic diaphragm 1 is made of the acrylic plate and the vibration transfer member 2 is made of the carbon fiber. However, the acoustic diaphragm 1 and the vibration transfer member 2 can be made of various materials.

The "internal loss" and the "sound velocity" differ according to materials. Therefore, the length (contact length) over which the vibration transfer member 2 touches the acoustic diaphragm 1 can be variously adjusted according to the material, the shape, the size and the like of one of or both of the acoustic diaphragm 1 and the vibration transfer member 2.

FIG. 5A to FIG. 5C and FIG. 6A to FIG. 6C are views for explaining a contact length of the vibration transfer member 2 with respect to the acoustic diaphragm 1.

Figure 5B:
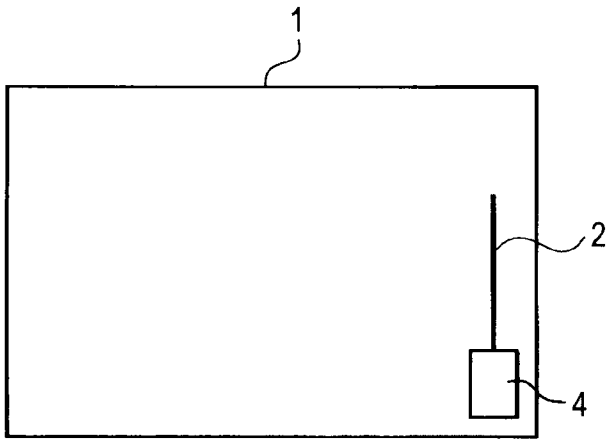
FIG. 5A to FIG. 5C are views for explaining a contact length of a vibration transfer member 2 with respect to an acoustic diaphragm 1.
Figure 5A:
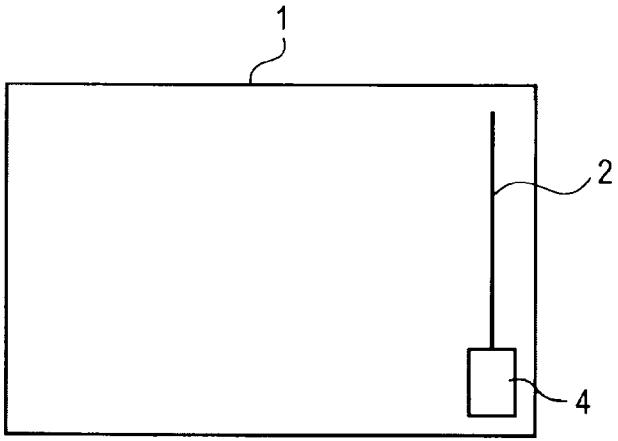

For example, when one of or both of materials used in the acoustic diaphragm 1 and the vibration transfer member 2 have not-so low "internal loss" and not-so high sound velocity, the vibration transfer member 2 is allowed to touch the acoustic diaphragm 1 over a longer length as shown in FIG. 5A.

Figure 5C:
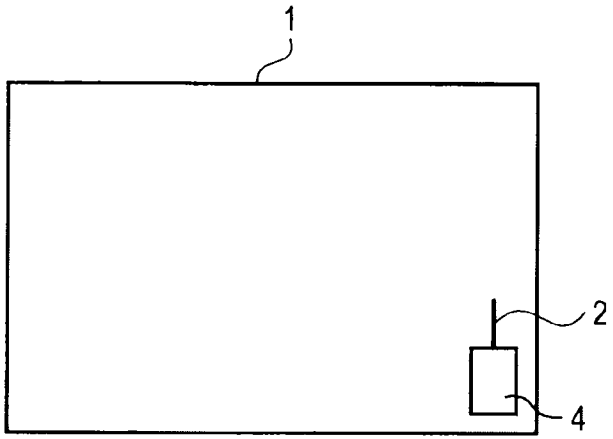

When one of or both of materials used in the acoustic diaphragm 1 and the vibration transfer member 2 have low "internal loss" and high "sound velocity", the length over which the vibration transfer member 2 touches the acoustic diaphragm 1 is made to be short as shown FIG. 5B and FIG. 5C.

Figure 6B:
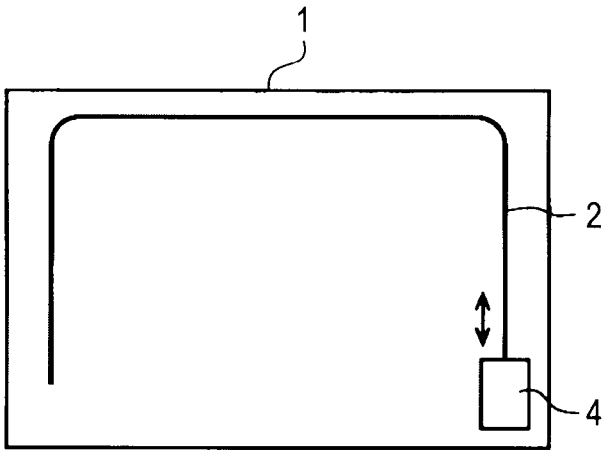
FIG. 6A to FIG. 6C are views for explaining a contact length of the vibration transfer member 2 with respect to the acoustic diaphragm 1.
Figure 6A:
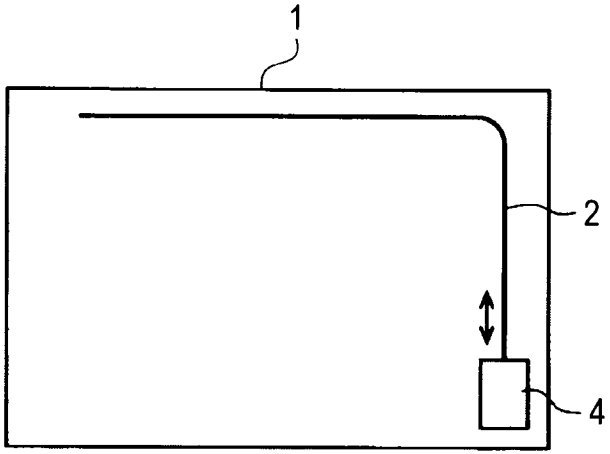
Figure 6C:
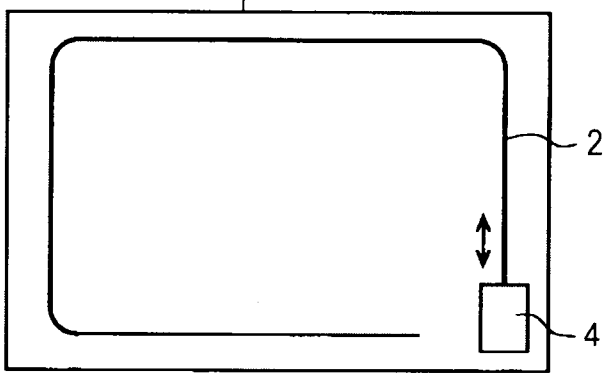

In order to transfer vibration to the acoustic diaphragm 1 more efficiently by one actuator, the vibration transfer member 2 can be provided in a state of touching the acoustic diaphragm 1, for example, along two edges, three edges and four edges of the acoustic diaphragm 1 as shown in FIG. 6A to FIG. 6C.

In this case, a folding portion is made in a curve for preventing deterioration of the transfer characteristics of vibration of the vibration transfer member 2. It is preferable that the vibration transfer member 2 is made in a curve having continuity.

As described above, the contact length of the vibration transfer member 2 with respect to the acoustic diaphragm 1 can be variously adjusted according to the material, the size, the shape and the like of one of or both of the acoustic diaphragm 1 and the vibration transfer member 2 so as to realize target acoustic characteristics (frequency characteristics, time response, phase characteristics and the like).

[Variations of Installation Positions and Installation Manners of the Vibration Transfer Member 2]

FIG. 7 to FIG. 12 are views for explaining variations of installation positions and installation manners when the vibration transfer member 2 is provided with respect to the acoustic diaphragm 1.

[Variation 1]

Figure 7:
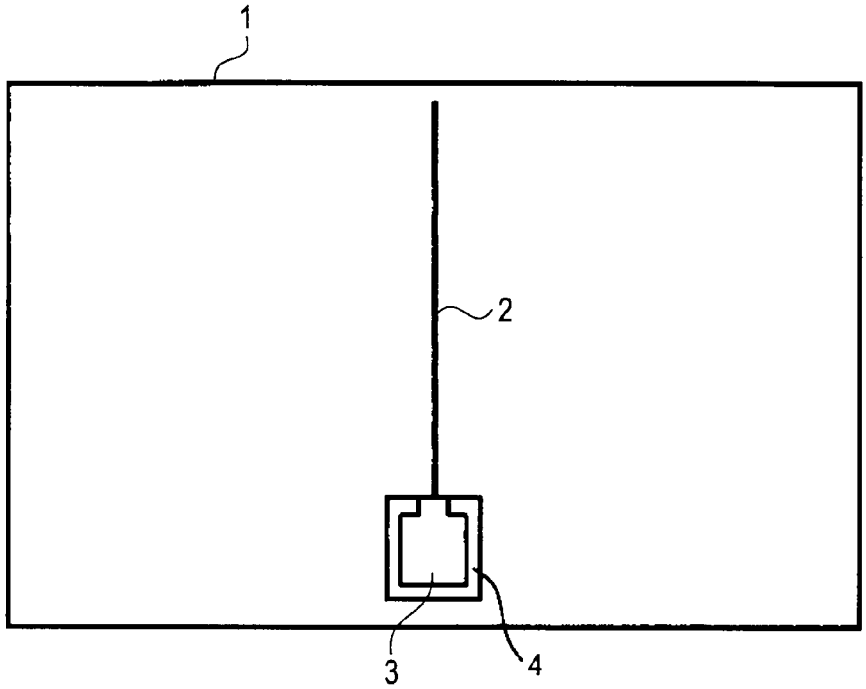
FIG. 7 is a view for explaining a variation of an installation position and an installation manner when the vibration transfer member 2 is provided with respect to the acoustic diaphragm 1.

In FIG. 1, the vibration transfer members 2 are respectively provided at both sides of the acoustic diaphragm 1. It is also preferable that one vibration transfer member 2 is provided at the central portion of the acoustic diaphragm 1 as shown in FIG. 7. In this case, only one square hole portion 4 for mounting the actuator 3 is necessary and one actuator 3 will be used.

[Variation 2]

Figure 8:
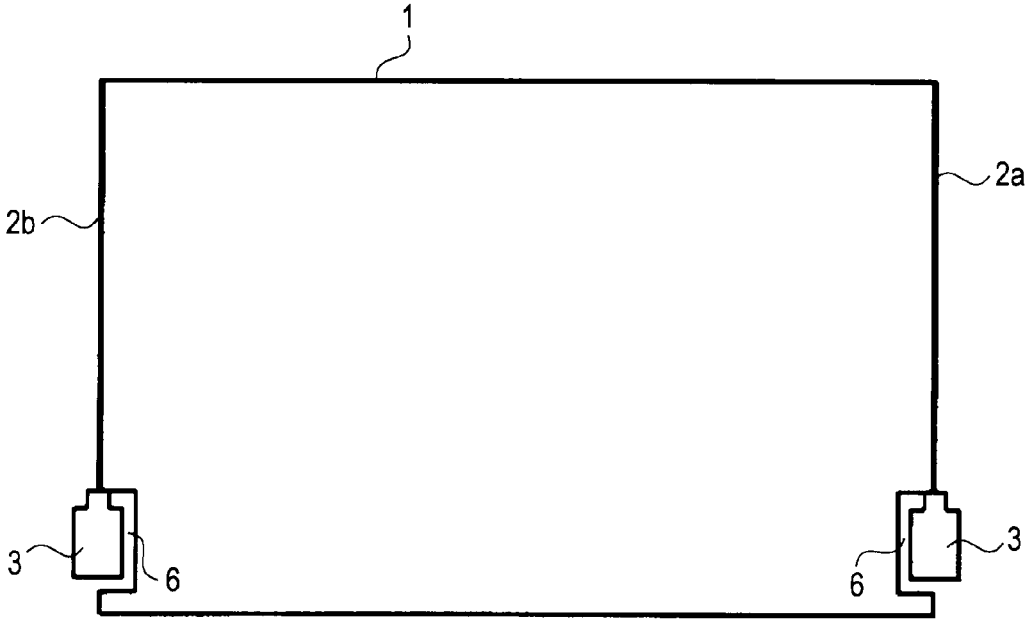
FIG. 8 is a view for explaining a variation of the installation position and the installation manner when the vibration transfer member 2 is provided with respect to the acoustic diaphragm 1.
Figure 9:
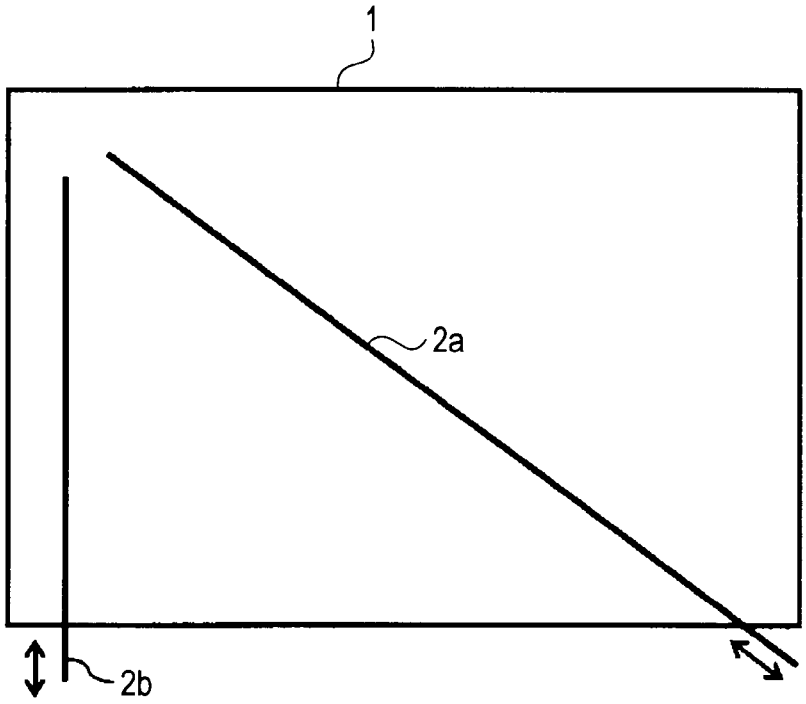
FIG. 9 is a view for explaining a variation of the installation position and the installation manner when the vibration transfer member 2 is provided with respect to the acoustic diaphragm 1.

It is also preferable that vibration transfer members 2*a*, 2*b* are provided at side surfaces of the acoustic diaphragm 1 as shown in FIG. 8, instead of providing the vibration transfer member 2 inside the acoustic diaphragm 1 as shown in FIG. 1.

In this case, notch portions 6 are provided under lower end portions of the vibration transfer members 2*a*, 2*b* as shown in FIG. 8 in order to mount actuators for adding vibration to the vibration transfer members 2*a*, 2*b* at suitable positions.

As described above, the vibration transfer member 2 can be provided in a state of touching the side surface and the like of the acoustic diaphragm 1, not limited to the case in which the vibration transfer member 2 is provided inside the acoustic diaphragm 1. In short, it is preferable that the vibration transfer member 2 is provided in a state of touching the acoustic diaphragm 1 while securing a certain degree of contact length with respect to the acoustic diaphragm 1.

In the case of the above speaker device, the entire or part of the actuator 3 is positioned inside the acoustic diaphragm 1 by providing the square hole portion 4 and the notch portion 6 at the acoustic diaphragm 1. However, it is also not limited to this.

It is also preferable that the actuator 3 is provided in a state of being positioned outside the acoustic diaphragm 1. In short, the actuator 3 can be provided at a suitable position where vibration can be added to the vibration transfer member 2 provided in a state of touching the acoustic diaphragm 1.

[Variation 3]

Though the vibration transfer member 2 is provided along a short edge of the acoustic diaphragm 1, it is not limited to this. For example, it is naturally preferable that the vibration transfer member is provided obliquely with respect to the acoustic diaphragm 1 as shown by the vibration transfer member 2*a* in FIG. 9. In this case, the vibration transfer member 2*a* is excited in the directions shown by both arrows near the vibration transfer member 2*a*, thereby transferring vibration to the acoustic diaphragm 1.

It is also preferable that the vibration transfer member is arranged in the vertical direction (along the short edge) of the acoustic diaphragm 1 shown by the vibration transfer member 2*b*. In this case, the vibration transfer member 2*b* is exited in the directions shown both arrows near the vibration transfer member 2*b*, thereby transferring vibration to the acoustic diaphragm 1.

[Vibration 4]

The acoustic diaphragm is made of, for example, the acrylic plate, and can be formed with a curved portion. For example, assume that a curved acoustic diaphragm 1*a* having curved portions is formed as shown in FIG. 10.

The vibration transfer member is formed in a stick shape by carbon fiber or it is a so-called piano wire formed by using steel as described above. Accordingly, it is possible to provide the vibration transfer member 2*a* in a state of touching along the curved portion of the curved acoustic diaphragm 1*a* as shown in FIG. 10.

In this case, the vibration transfer member 2*a* is excited in the directions shown by both arrows near the vibration transfer member 2*a*, thereby transferring vibration to the acoustic diaphragm 1*a*.

Figure 10:
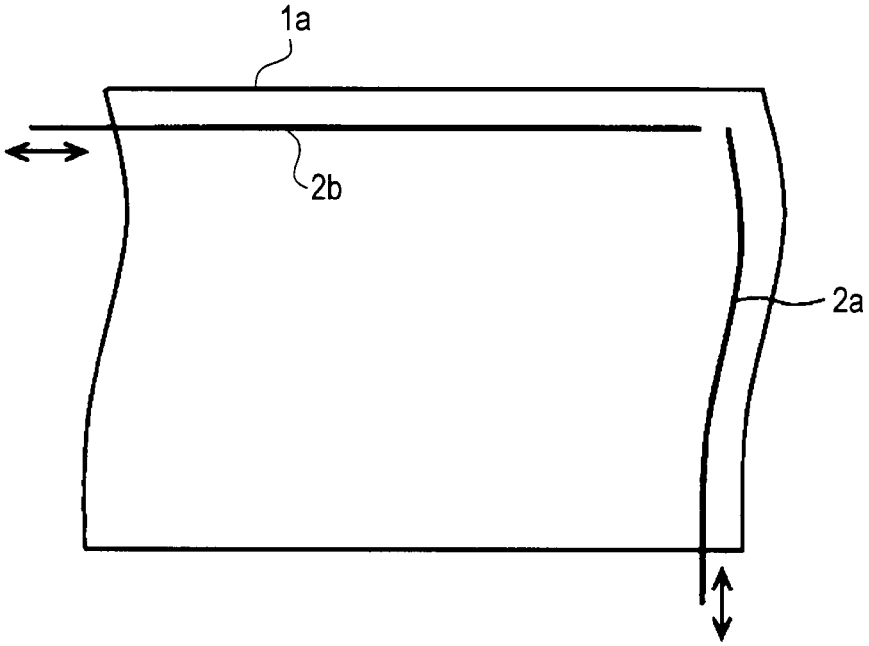
FIG. 10 is a view for explaining a variation of the installation position and the installation manner when the vibration transfer member 2 is provided with respect to the acoustic diaphragm 1.

In FIG. 10, it is also preferable that the vibration transfer member is provided along the horizontal direction of the acoustic diaphragm 1*a* (along the long edge) as shown by the vibration transfer member 2*b*. In this case, the vibration transfer member 2*b* is excited in the directions shown by both arrows near the vibration transfer member 2*b*, thereby transferring vibration to the acoustic diaphragm 1*a*.

As described above, the vibration transfer member can be arranged at various positions in the acoustic diaphragm. Even when the acoustic diaphragm has a curved portion, the vibration transfer member can be arranged along the curved portion to properly transfer vibration to the acoustic diaphragm having the curved portion.

[Variation 5]

In the above examples in the embodiment, one actuator excites one vibration transfer member, however, it is not limited to this. It is also preferable to apply a structure in which plural vibration transfer members are excited by one actuator or in which the vibration transfer member formed to be divided is excited by one actuator.

Figure 11:
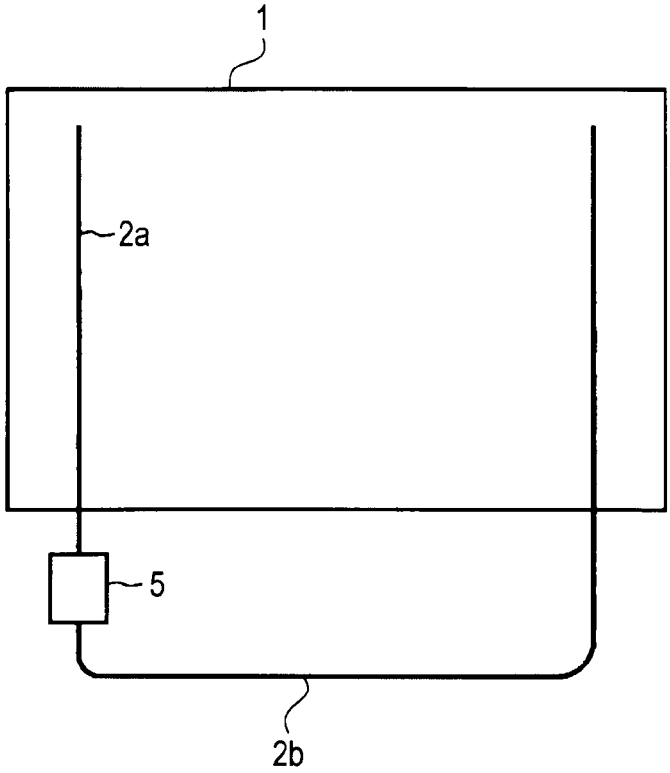
FIG. 11 is a view for explaining a variation of the installation position and the installation manner when the vibration transfer member 2 is provided with respect to the acoustic diaphragm 1.

FIG. 11 is an example of the speaker device configured to excite two vibration transfer members 2*a*, 2*b* by a both-ends actuator 5.

In FIG. 11, the both-ends actuator 5 is configured to have the drive rod 35 and the damping material 37 also at the lower side, not only at the upper side, in the giant magnetostrictive actuator 3 explained using FIGS. 2A and 2B.

Accordingly, the both-ends actuator 5 excites the vibration transfer members 2*a* provided at the left side of the acoustic diaphragm 1 by one drive rod and excites the vibration transfer members 2*b* provided at the right side of the acoustic diaphragm 1 by the other drive rod.

Additionally, the vibration transfer members 2*a*, 2*b* are provided in a state of touching the acoustic diaphragm 1, therefore, the vibration given by the both-end actuator 5 is transferred to the acoustic diaphragm 1 efficiently by the vibration transfer members 2*a*, 2*b*.

[Variation 6]

Figure 12:
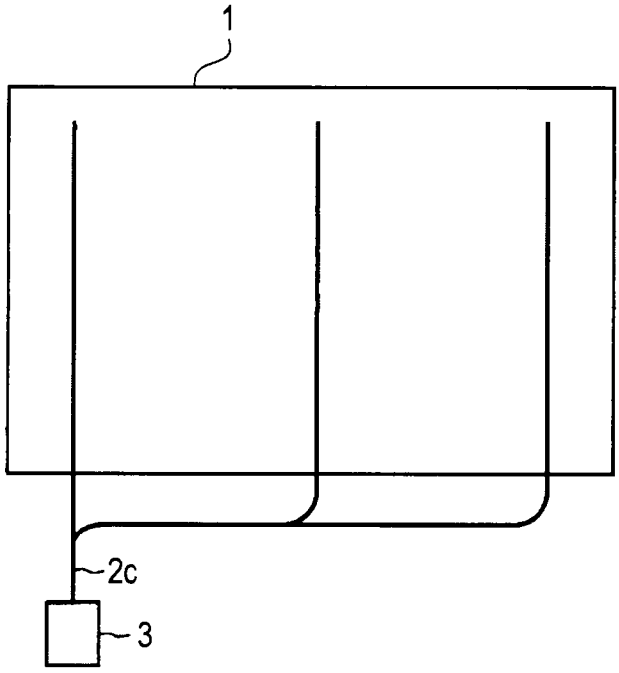
FIG. 12 is a view for explaining a variation of the installation position and the installation manner when the vibration transfer member 2 is provided with respect to the acoustic diaphragm 1.

FIG. 12 is an example of the speaker device configured by using a vibration transfer member 2*c* formed to be divided on the way.

In FIG. 12, the actuator 3 has the structure explained using FIGS. 2A and 2B. The vibration transfer member 2*c* used in the example of the speaker device has a structure of being divided into three on the way as shown in FIG. 12.

As shown in FIG. 12, the vibration transfer member 2*c* is configured so that one of the divided three members touches the left side portion of the acoustic diaphragm 1, another one of them touches the center portion of the acoustic diaphragm 1 and the remained member touches the right side portion of the acoustic diaphragm 1.

In the vibration transfer member 2*c*, divided portions are formed to be curved. Accordingly, reduction of transfer efficiency of vibration is prevented at respective divided portions of the vibration transfer member 2*c*.

In the case of the example, end portions of the vibration transfer member 2*c* are excited by the actuator 3, thereby transferring vibration to the entire acoustic diaphragm 1 efficiently through divided respective portions.

As described above, it is possible to transfer vibration to the acoustic diaphragm 1 more efficiently by applying structures such that plural vibration transfer members are excited by one actuator or that the vibration transfer member is formed to be divided by one actuator.

The examples shown in FIG. 11 and FIG. 12 are merely examples, and positions of the vibration transfer member to be provided at the acoustic diaphragm 1, and the number of dividing the vibration transfer members are preferably selected.

Modified Examples of Shapes of the Acoustic Diaphragm and how to Use the Acoustic Diaphragm The acoustic diaphragm is not limited to the rectangular shape as described above. For example, it can be various shapes such as a circular shape, a semi-circular shape, a sector shape, a triangular shape and a star shape. The acoustic diaphragm can be also various three-dimensional shapes.

Example of an Acoustic Diaphragm Having a Three-Dimensional Shape

Modification Example 1

Figure 13:
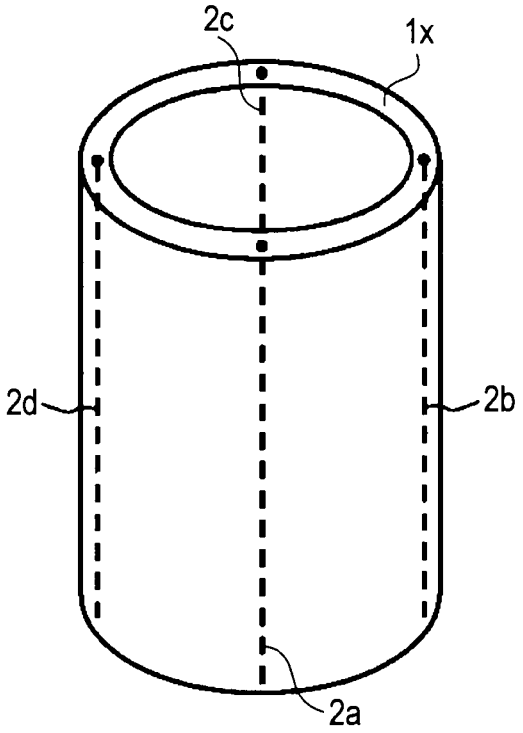
FIG. 13 is a view for explaining an example of an acoustic diaphragm formed to have a cylindrical shape.

FIG. 13 is a view for explaining an example of an acoustic diaphragm formed to have a cylindrical shape. As shown in FIG. 13, an acoustic diaphragm 1*x* formed to have a cylindrical shape has, for example, a thickness of approximately several mm.

Inside the acoustic diaphragm 1*x*, vibration transfer members 2*a*, 2*b*, 2*c* and 2*d* are provided at positions excited by the actuator from the bottom side of the acoustic diaphragm 1*x* as well as in the height direction of the acoustic diaphragm 1*x*.

The respective vibration transfer members 2*a*, 2*b*, 2*c* and 2*d* are exposed at the bottom surface side of the acoustic diaphragm 1, which can be excited by the actuator directly.

Accordingly, vibration corresponding to an audio signal can be efficiently transferred over the entire acoustic diaphragm 1*x* through the vibration transfer members 2*a*, 2*b*, 2*c* and 2*d* even in the case of using the acoustic diaphragm 1*x* formed to have the cylindrical shape.

Therefore, it is possible to realize high quality audio to be discharged by further widening the frequency band of audio signals which can be discharged.

In the case of the acoustic diaphragm formed to have the cylindrical shape has been explained, however, it is not limited to this. It is possible to form the acoustic diaphragm to have prismatic shapes of various number of corners, such as a triangular prism, a quadratic prism, a pentangular prism and a hexagonal prism.

It is also preferable that the acoustic diaphragm is formed to have various three-dimensional shapes such as a sphere shape or a hemisphere shape.

In cases where the acoustic diaphragm having any three-dimensional shape is used, the vibration transfer member may be provided at a position which can be excited by the actuator. The number of providing the vibration transfer members is determined according to actuators and the length of the vibration transfer member can be appropriately determined.

It is not necessary that the vibration transfer member is provided by being buried inside the acoustic diaphragm and the vibration transfer member may be fixed by various methods in a state of touching any position of the acoustic diaphragm.

Example of Using Plural Acoustic Diaphragms

Modification Example 2

The vibration transfer member is provided in a state of touching the acoustic diaphragm as described above, thereby transferring signals from the actuator efficiently through the vibration transfer member.

Accordingly, the acoustic diaphragm can use various materials, for example, paper, metals such as magnesium, plastic, and other kinds of materials, not limited to the acrylic plate. Additionally, plural acoustic diaphragms can be used, not limited to one diaphragm.

The example of using plural acoustic diaphragms will be explained below. In the example explained below, a case in which acoustic diaphragms having different materials are used will be also explained.

First Example of the Case where Plural Acoustic Diaphragms are Used

Figure 14:
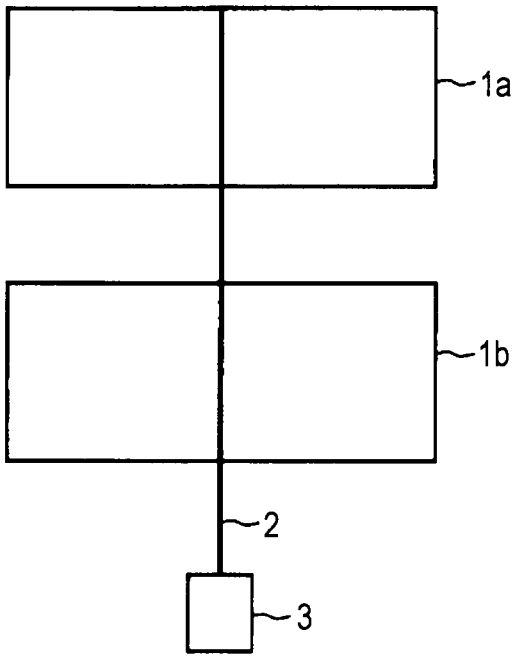
FIG. 14 is a view for explaining an example of the speaker device using two acoustic diaphragms 1*a*, 1*b;*

FIG. 14 is a view for explaining an example of the speaker device using two acoustic diaphragms 1*a*, 1*b*. As shown in FIG. 14, the acoustic diaphragm 1*a* is made of magnesium, and the acoustic diaphragm 1*b* is made of paper. Respective acoustic diaphragms 1*a*, 1*b* have a certain degree of thickness and are not curled up or folded even when the user does not press them.

As shown in FIG. 14, the vibration transfer member 2 is provided in a state of touching central portions of respective acoustic diaphragms 1*a*, 1*b*. In this case, the vibration transfer member 2 is adhered to the acoustic diaphragms 1*a*, 1*b*, for example, by an adhesive.

The vibration transfer member 2 is the member having low "internal loss" as well as high "sound velocity" such as the member made of carbon fiber to have a stick shape and the piano wire formed by using steel in the same manner as the above embodiment.

The acoustic diaphragm 1*a* formed by using magnesium has relatively low internal loss and has good reaction to vibration in a high frequency part (high frequency side). Accordingly, the acoustic diaphragm 1*a* is used for discharging audio in the high frequency side.

The acoustic diaphragm 1*b* formed by using paper has internal loss larger than the magnesium and has good reaction to vibration in a low frequency part (low frequency side). Accordingly, the acoustic diaphragm 1*b* is used for discharging audio in the low frequency side.

Figure 15:
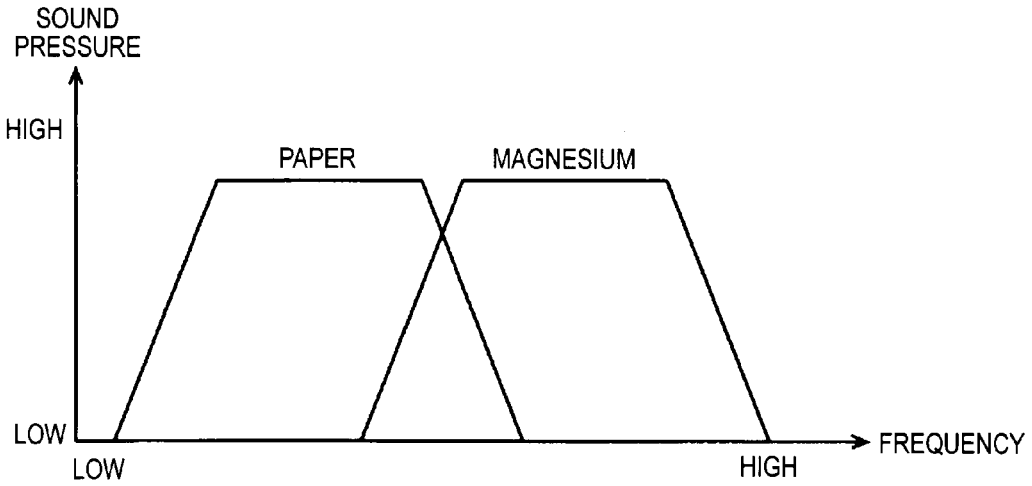
FIG. 15 is a graph for explaining vibration characteristics of magnesium and paper.

FIG. 15 is a graph for explaining vibration characteristics of magnesium and paper. As shown in FIG. 15, the acoustic diaphragm 1*a* made of magnesium reacts to high-frequency vibration, which can discharge audio in the high frequency with high sound pressure. On the other hand, the acoustic diaphragm 1*b* made of paper reacts to low frequency vibration, which can discharge audio in the low frequency with high sound pressure as shown in FIG. 15.

Then, vibration corresponding to an audio signal is excited to the end portion of the vibration transfer member 2 provided in a state of touching the acoustic diaphragms 1*a*, 1*b* respectively by the actuator 3 as shown in FIG. 14.

Accordingly, vibration corresponding to the audio signal is transferred efficiently to respective acoustic diaphragms 1*a*, 1*b* through the vibration transfer member 2, and audio corresponding to the transferred vibration is discharged from the acoustic diaphragms 1*a*, 1*b*.

In this case, the acoustic diaphragms 1*a* made of magnesium and the acoustic diaphragm 1*b* made of paper are used, thereby expanding reproducing frequency characteristics both to the high frequency side and to the low frequency side. That is, the reproducing frequency characteristics can be expanded and the good reproduced sound field can be formed in a comprehensive manner.

Second Example of the Case where Plural Acoustic Diaphragms are Used

Figure 16:
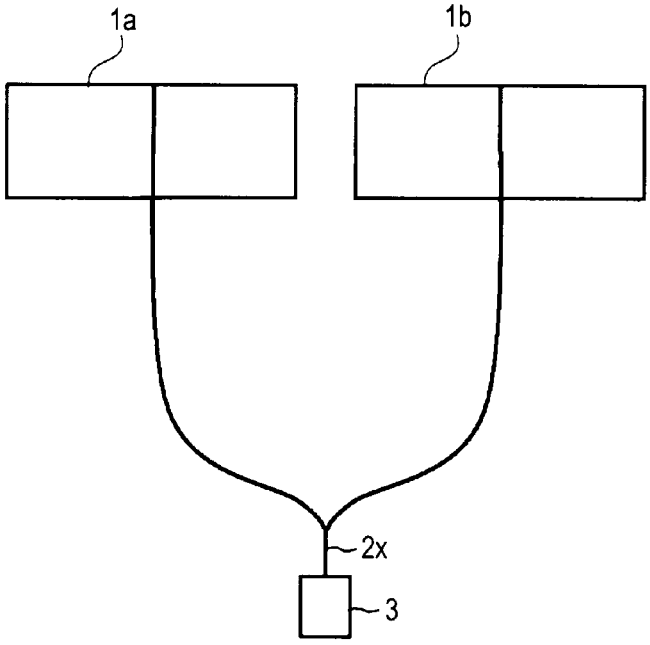
FIG. 16 is a view for explaining another example of the speaker device using two acoustic diaphragms 1*a*, 1*b;*

FIG. 16 is a view for explaining another example of the speaker device using two acoustic diaphragms 1*a*, 1*b*. As shown in FIG. 16, the acoustic diaphragm 1*a* is made of magnesium, and the acoustic diaphragm 1*b* is made of paper also in the embodiment. Respective acoustic diaphragms 1*a*, 1*b* have a certain degree of thickness and are not curled up or folded even when the user does not press them also in the embodiment.

As shown in FIG. 16, a vibration transfer member 2*x* is provided in a state of touching central portions of respective acoustic diaphragms 1*a*, 1*b* also in the example. Also in this example, the vibration transfer member 2*x* is adhered to the acoustic diaphragms 1*a*, 1*b*, for example, by an adhesive.

The vibration transfer member 2*x* is the member having low "internal loss" as well as high "sound velocity" such as the member made of carbon fiber to have a stick shape and the piano wire formed by using steel in the same manner as the speaker device of the first example shown in FIG. 14.

However, the vibration transfer member 2*x* in this example is formed to be divided into two as shown in FIG. 16. The divided portion is formed to be curved for preventing vibration from being attenuated.

As shown in FIG. 16, an end portion of the vibration transfer member 2*x* is excited by the actuator 3. Accordingly, vibration corresponding to excitation by the actuator 3 is transferred to respective acoustic diaphragms 1*a*, 1*b* through the vibration transfer member 2*x*.

Accordingly, vibration is transferred to respective acoustic diaphragms 1*a*, 1*b* efficiently through the vibration transfer member 2*x* which is formed to be divided, and audio corresponding to the transferred vibration is discharged from the respective acoustic diaphragms 1*a*, 1*b*.

In this case, the acoustic diaphragms 1*a* made of magnesium and the acoustic diaphragms 1*b* made of paper are used, thereby expanding reproducing frequency characteristics both to the high frequency side and to the low frequency side in the same manner as the speaker device explained with reference to FIG. 14. That is, the reproducing frequency characteristics can be expanded and the good reproduced sound field can be formed in a comprehensive manner.

The vibration transfer member 2*x* divided into two is used in the case of this example, thereby transferring vibration to respective acoustic diaphragms 1*a*, 1*b* equally (uniformly).

Third Example of the Case where Plural Acoustic Diaphragms are Used

Figure 17:
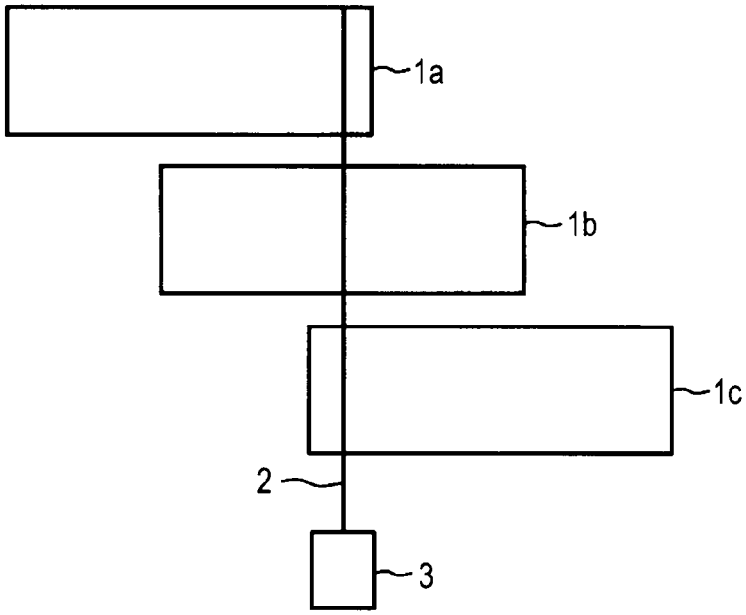
FIG. 17 is a view for explaining an example of the speaker device using three acoustic diaphragms 1*a*, 1*b* and 1*c;*

FIG. 17 is a view for explaining an example of the speaker device using three acoustic diaphragms 1*a*, 1*b* and 1*c*. As shown in FIG. 17, the acoustic diaphragm 1*a* is made of magnesium, and the acoustic diaphragms 1*b*, 1*c* are made of paper. Respective acoustic diaphragms 1*a*, 1*b* and 1*c* have a certain degree of thickness and are not curled up or folded even when the user does not press them also in this example.

As shown in FIG. 17, the vibration transfer member 2 is provided in a state of touching respective acoustic diaphragms 1*a*, 1*b* and 1*c*. Also in this case, the vibration transfer member 2 is adhered to respective acoustic diaphragms 1*a*, 1*b* and 1*c*, for example, by an adhesive.

In the case of this example, the vibration transfer member 2 touches respective acoustic diaphragms 1*a*, 1*b* and 1*c* at different positions respectively. That is, the vibration transfer member 2 touches the acoustic diaphragm 1*a* at the right-end side thereof. The vibration transfer member 2 touches the acoustic diaphragm 1*b* at the central portion thereof. The vibration transfer member 2 touches the acoustic diaphragm 1*c* at the left-end side thereof.

Also in this example, the vibration transfer member 2 is the member having low "internal loss" as well as high "sound velocity" such as the member made of carbon fiber to have a stick shape and the piano wire formed by using steel in the same manner as the above embodiment.

Also in the example, the acoustic diaphragm 1*a* made of magnesium is used for discharging audio in the high frequency side in the same manner as the above cases of first and second examples. Also in the example, the acoustic diaphragm 1*b* made of paper is used for discharging audio in the low frequency side in the same manner as the above cases of first and second examples.

Vibration corresponding to an audio signal is excited to the end portion of the vibration transfer member 2 formed in a state of touching respective acoustic diaphragms 1*a*, 1*b* and 1*c* by the actuator 3 as shown in FIG. 17.

Accordingly, vibration corresponding to the audio signal is transferred to respective acoustic diaphragms 1*a*, 1*b* and 1*c* efficiently through the vibration transfer member 2, and audio corresponding to the transferred vibration is discharged from respective acoustic diaphragms 1*a*, 1*b* and 1*c*.

In this case, the acoustic diaphragms 1*a* made of magnesium and the acoustic diaphragms 1*b*, 1*c* made of paper are used, thereby expanding reproducing frequency characteristics both to the high frequency side and to the low frequency side. That is, the reproducing frequency characteristics can be expanded and the good reproduced sound field can be formed in a comprehensive manner.

Fourth Example of the Case where Plural Acoustic Diaphragms are Used

Figure 18:
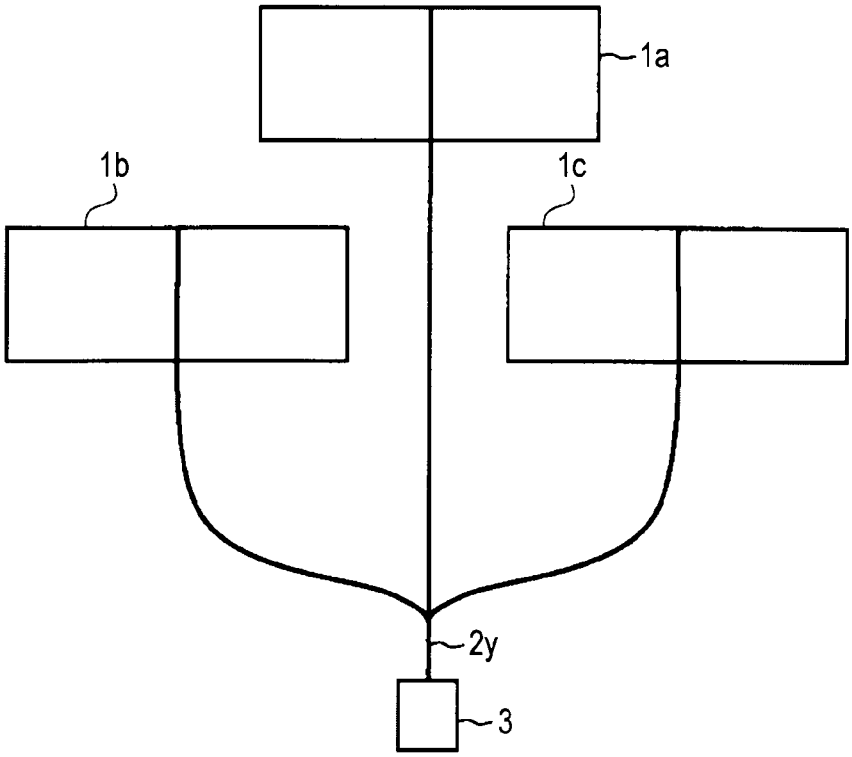
FIG. 18 is a view for explaining another example of the speaker device using three acoustic diaphragms 1*a*, 1*b* and 1*c*.

FIG. 18 is a view for explaining an example of the speaker device using three acoustic diaphragms 1*a*, 1*b* and 1*c*. As shown in FIG. 18, the acoustic diaphragm 1*a* is made of magnesium, and the acoustic diaphragms 1*b*, 1*c* are made of paper also in the case of this example. Respective acoustic diaphragms 1*a*, 1*b* and 1*c* have a certain degree of thickness and are not curled up or folded even when the user does not press them also in this example.

As shown in FIG. 18, a vibration transfer member 2*y* is provided in a state of touching central portions of respective acoustic diaphragms 1*a*, 1*b* and 1*c* in this example. In this case, the vibration transfer member 2*y* is adhered to the acoustic diaphragms 1*a*, 1*b* and 1*c*, for example, by an adhesive.

The vibration transfer member 2*y* is the member having low "internal loss" as well as high "sound velocity" such as the member made of the carbon fiber to have a stick shape and the piano wire formed by using steel in the same manner as the speaker devices of the above first to third examples.

However, the vibration transfer member 2*y* in this example is formed to be divided into three as shown in FIG. 18. The divided portion is formed to be curved for preventing vibration from being attenuated.

As shown in FIG. 18, an end portion of the vibration transfer member 2*y* is excited by the actuator 3. Accordingly, vibration corresponding to excitation by the actuator 3 is transferred to respective acoustic diaphragms 1*a*, 1*b* and 1*c* through the vibration transfer member 2*y*.

Accordingly, vibration is transferred to respective acoustic diaphragms 1*a*, 1*b* and 1*c* efficiently through the vibration transfer member 2*y*, and audio corresponding to the transferred vibration is discharged from the respective acoustic diaphragms 1*a*, 1*b* and 1*c*.

In this case, the acoustic diaphragms 1*a* made of magnesium and the acoustic diaphragms 1*b*, 1*c* made of paper are used, thereby expanding reproducing frequency characteristics both to the high frequency side and to the low frequency side. That is, the reproducing frequency characteristics can be expanded and the good reproduced sound field can be formed in a comprehensive manner.

The vibration transfer member 2*y* divided into three is used in the case of this example, thereby transferring vibration to respective acoustic diaphragms 1*a*, 1*b* and 1*c* equally (uniformly).

Other Examples of the Case where Plural Acoustic Diaphragms are Used

The number of acoustic diaphragms to be used can be the appropriate number. In this case, it is also preferable to apply a configuration in which respective acoustic diaphragms are excited by different actuators. As explained with reference to FIG. 16, FIG. 18, it is possible to transfer vibration to plural acoustic diaphragms from one actuator by dividing the vibration transfer member.

The acoustic diaphragm can have various shapes such as a circular shape, a sector shape and a triangular shape. Plural acoustic diaphragms can be formed to have different shapes respectively. The acoustic diaphragms are also allowed to have different shapes or sizes respectively. For example, it is possible to make the acoustic diaphragm discharging audio in low frequency side larger than the acoustic diaphragm discharging audio in high frequency side.

The materials of the acoustic diaphragm are not limited to magnesium and paper. Needless to say, it is possible to use only the acoustic diaphragm made of magnesium or to use only the acoustic diaphragm made of paper. It is also possible to use acoustic diaphragms made of materials other than magnesium and paper. For example, the acoustic diaphragms made by using various materials such as plastic, glass, and various types of fibers can be applied.

Application of the Speaker Device According to an Embodiment

Modification Example 3

Figure 19:
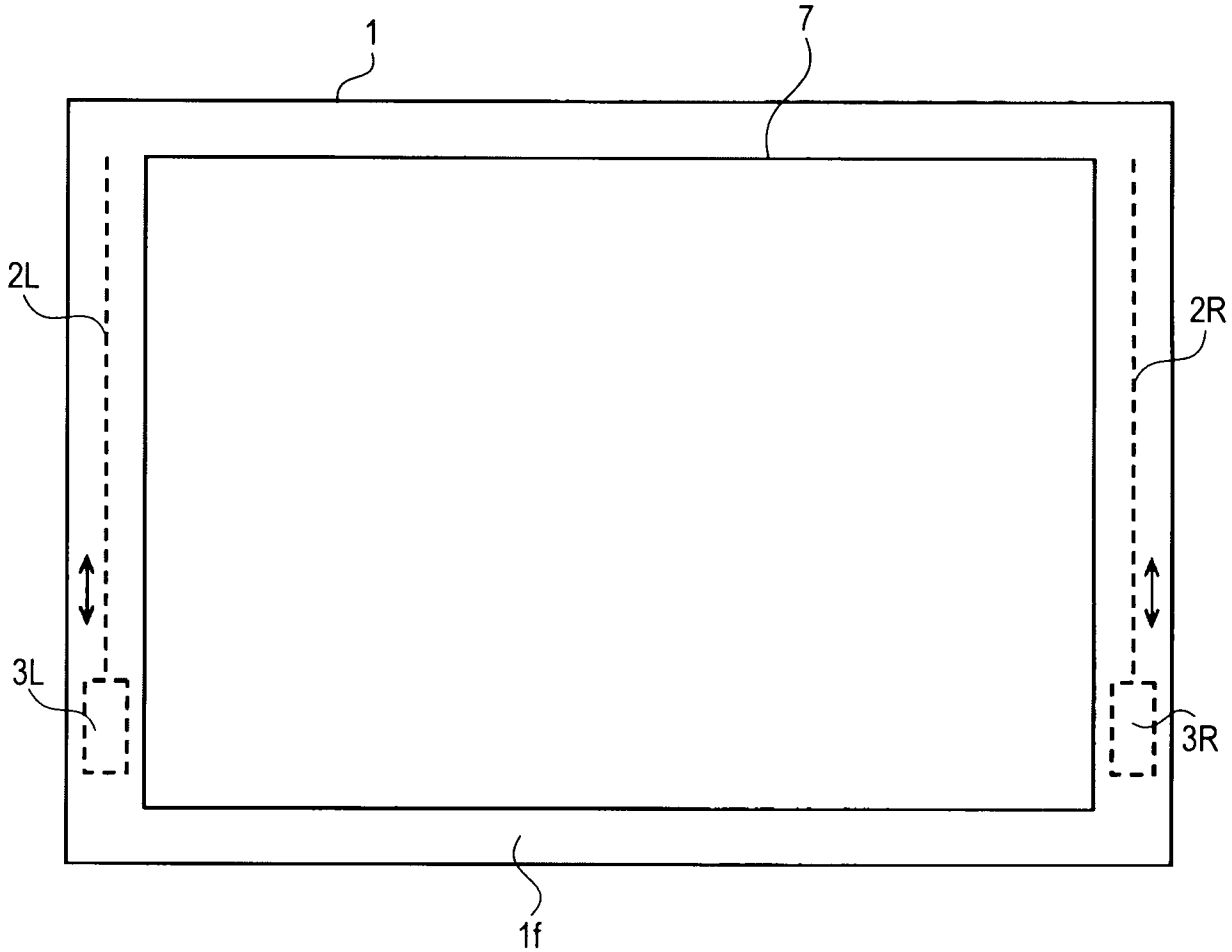
FIG. 19 is a view for explaining an application of the speaker device according to an embodiment of the invention.

FIG. 19 is a view for explaining an application of the speaker device according to an embodiment of the invention. The application shown in FIG. 19 is a case in which the speaker device according to an embodiment of the invention is applied to a display device such as a television receiver.

The speaker device in the example basically includes the acoustic diaphragm made of, for example, the acrylic plate, the vibration transfer member such as the carbon fiber or the piano wire and the actuator exciting the vibration transfer member in the same manner as the speaker device explained by using FIG. 1, FIGS. 2A and 2B and so on.

The speaker device of the example is provided in the front-face side of a display element such as a CRT (Cathode Ray Tube), an LCD (Liquid Crystal Display), an organic EL (Electroluminescence) panel or a PDP (Plasma Display Panel) as shown in FIG. 19.

Specifically, the acoustic diaphragm 1 made of, for example, the acrylic plate is provided in the front side of a display element 7 as shown in FIG. 19. In the acoustic diaphragm 1, a vibration transfer member 2L is provided in the left side of a frame 1*f* which is a circumferential portion of a display screen of the display element 7 and a vibration transfer member 2R is provided in the right side of the frame 1*f*.

These vibration transfer members 2L, 2R are provided in a state of touching the vibration transfer member 1 respectively. An actuator 3L is provided at the lower end side of the vibration transfer member 2L and an actuator 3R is provided at the lower end side of the vibration transfer member 2R.

Then, vibration corresponding to an audio signal is added to the vibration transfer members 2L, 2R from the lower end side by the actuators 3L, 3R as shown by both arrows in FIG. 19.

In this case, the actuator 3L generates vibration corresponding to an audio signal of a left channel in audio signals of right-and-left two channels. Similarly, the actuator 3R generates vibration corresponding to an audio signal of a right channel in audio signals of right-and-left two channels.

Accordingly, vibration corresponding to the audio signal of the left channel is transferred mainly to the left side of the acoustic diaphragm 1 efficiently through the vibration transfer member 2L, and audio corresponding to the transferred vibration is discharged from the left side of the acoustic diaphragm 1.

Similarly, vibration corresponding to the audio signal of the right channel is transferred mainly to the right side of the acoustic diaphragm 1 efficiently through the vibration transfer member 2R, and audio corresponding to the transferred vibration is discharged from the right side of the acoustic diaphragm 1.

In this case, the acoustic diaphragm 1 positioned in the front-face side of the display screen of the display element 7 is vibrated to thereby discharge audio, therefore, audio corresponding to video to be displayed is discharged from the same direction as the display screen of the display element on which video is displayed.

Accordingly, audio which should be reproduced in synchronization with the video can be discharged from the same direction as the display screen on which video is displayed, therefore, reproduced video as well as corresponding audio can be viewed and listened to comfortably.

Advantages of the Embodiment

In the speaker device according to the embodiment, the vibration transfer member for transferring the compression wave corresponding to vibration from the actuator is provided in a state of touching the acoustic diaphragm, thereby transferring the compression wave to the acoustic diaphragm efficiently.

That is, even when mechanical impedances of the acoustic diaphragm and the actuator are not sufficiently matched, transfer efficiency (propagating efficiency) of vibration can be improved by using the vibration transfer member.

According to the above, the speaker device covering the frequency band wider than related art devices can be realized. Also concerning the sound image orientation effect, more uniform sound image orientation effect can be obtained over the entire acoustic diaphragm.

The speaker devices covering further wider frequency band can be realized by applying a configuration using plural acoustic diaphragms made of different materials.

Also, vibration can be efficiently transferred by applying the configuration in which the vibration transfer member is allowed to touch the acoustic diaphragm, therefore, it becomes possible to use materials which have not been used as the acoustic diaphragm in related art devices.

For example, a thin plastic, a craft paper, a thinly-processed magnesium plate can be used. Accordingly, it becomes easy to process the acoustic diaphragm and the speaker device having design largely different from related-art speakers can be realized. That is, it is possible to expand the degree of freedom in designing the speaker device.

[Others]

[Materials, Shapes and Sizes of Components]

As described above, the acoustic diaphragm having various materials, shapes and sizes can be used. Also, the vibration transfer member having various materials, shapes and sizes can be used. The number of acoustic diaphragms, the number of vibration transfer members and the number of actuators can be appropriately determined.

The above material, shape and size of the acoustic diaphragm as well as the material, shape and size of the vibration transfer member, further, the number of acoustic diaphragms, the number of vibration transfer members and the number of actuators can be appropriately selected within a range in which acoustic characteristics (frequency characteristics, time response, phase characteristics and the like) which are targets for discharged sound can be realized.

As have been described above, the vibration transfer member 2 having low "internal loss" and high "sound velocity" as compared with the acoustic diaphragm 1 is preferably used. Here, the selection of materials for the acoustic diaphragm 1 and the vibration transfer member 2 will be specifically shown.

For example, it can be considered that, as materials for forming the acoustic diaphragm 1, epoxy resin, paper (cone paper) and the like can be used. Here, the "internal loss" of the epoxy resin is 0.026 and the "sound velocity" thereof is 1700 m/sec (millisecond). The "internal loss" of the paper (cone paper) is 0.04 and the "sound velocity" thereof is 1650 m/sec (millisecond).

Accordingly, when using the epoxy resin or the paper (cone paper) as the acoustic diaphragm 1, it is necessary to use the vibration transfer member 2 having lower internal loss than the above internal loss as well as higher sound velocity than the above sound velocity.

In this case, as a candidate for the vibration transfer member 2, for example, titanium can be cited. The "internal loss" of titanium is 0.002 and the "sound velocity" thereof is 4950 m/sec. Accordingly, when using the epoxy resin or the paper (cone paper) as the acoustic diaphragm 1, the vibration transfer member 2 made of, for example, titanium is used to thereby transfer the signal from the actuator to the acoustic diaphragm 1 efficiently through the vibration transfer member 2.

As described above, it is preferable that the vibration transfer member 2 is formed by using various materials having sufficiently low "internal loss" as well as sufficiently high "sound velocity" as compared with the material of the acoustic diaphragm 1 to be used.

As for the actuator, various types of actuators such as a piezoelectric actuator, an electromotive actuator and a giant magnetostrictive actuator can be used.

As for the paper used as the acoustic diaphragm, various types of papers can be used. For example, a drawing paper, a craft paper, converted papers to which various processes have been performed and the like can be used.

Structure Example of the Vibration Transfer Member

The length of the vibration transfer member 2 is not always predetermined. It is also preferable to use the vibration transfer member 2 having structures the length of which can be adjusted. For example, the structure of the vibration transfer member can be a so-called antenna rod structure in which plural vibration transfer members having different girths can expand and contract.

Additionally, plural vibration transfer members in which threads (male threads at one side and female threads at the other side) are cut at the tips thereof are prepared, and the male threads and the female threads are connected together to form one vibration transfer member if necessary.

Then, the vibration transfer member having the length shown in FIG. 5B and the vibration transfer member having the length shown in FIG. 5C are connected so as to be expanded and contracted if necessary, or they are configured so as to be connected if necessary.

Accordingly, the vibration transfer member can be adjusted by the user himself/herself, for example, when the acoustic diaphragm has relatively high internal loss, the vibration transfer member is elongated and allowed to touch the diaphragm, on the other hand, when the acoustic diaphragm has relatively low internal loss, the vibration transfer member is adjusted to be short and allowed to touch the diaphragm.

As described above, since the length of the vibration transfer member is configured to be adjustable, it is convenient when it is necessary to adjust a contact state between the acoustic diaphragm and the vibration transfer member, for example, in the case where the audio diaphragm and the vibration transfer member can be selected by the user himself/herself.

[Applicable Apparatus and so on]

In the above embodiment, the case where the speaker device according to the embodiment of the invention is applied to the television receiver has been explained, however, it is not limited to this. The speaker device according to the embodiment of the invention can be applied to other apparatuses other than the television receiver. For example, the speaker device according to the embodiment of the invention can be applied to a cellular phone terminal, a portable game and the like.

Particularly, the speaker device according to the embodiment of the invention can be applied to a flip-type portable information terminal. In the flip-type portable information terminal, for example, when the acoustic diaphragm is provided in a display screen and the actuator is provided in the body, the vibration transfer member can be bent, therefore, the portable information terminal can be folded. Also in this case, when the vibration transfer member is in a state of being stretched when the portable information terminal is used, the vibration transfer member can transfer vibration efficiently to the acoustic diaphragm.

The invention can be also applied to windowpanes such as windshields of a vehicle. The speaker device according to the embodiment of the invention can be applied to various positions such as windows of a house, mirrors in a rest room or a bath room, and a mirror of a dressing table placed on a room.

The present application contains subject matter related to that disclosed in Japanese Priority Patent Application JP 2009-114119 filed in the Japan Patent Office on May 11, 2009, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A speaker device comprising:

an acoustic diaphragm;

a vibration transfer member disposed in contact with the acoustic diaphragm over a predetermined length of the acoustic diaphragm, a shape of the vibration transfer member being elongated in a longitudinal direction such that a central axis, which extends in the elongated longitudinal direction of the vibration transfer member, extends along a direction of a surface of the acoustic diaphragm, the vibration transfer member being longer in the longitudinal direction than in a width direction thereof, and the vibration transfer member being configured to transfer vibration to the acoustic diaphragm; and an actuator disposed at an end of the central axis of the vibration transfer member in the longitudinal direction, the actuator being configured to add vibration corresponding to an audio signal to be reproduced to the vibration transfer member to thereby transfer vibration to the acoustic diaphragm through the vibration transfer member and to generate sound.

2. The speaker device according to claim 1, wherein the predetermined length of the vibration transfer member that is in contact with the acoustic diaphragm is adjusted so as to realize a target acoustic characteristic.

3. The speaker device according to claim 1, wherein the vibration transfer member includes a curved portion while maintaining continuity of the contact with the acoustic diaphragm along an extension of the vibration transfer member including the curved portion in the direction of the surface of the acoustic diaphragm.

4. The speaker device according to claim 1, wherein the vibration transfer member includes a plurality of vibration transfer members provided with respect to a plurality of positions in the acoustic diaphragm, and wherein the actuator adds vibration to the plurality of vibration transfer members.

5. The speaker device according to claim 1, wherein the vibration transfer member is configured so that the predetermined length thereof can be adjusted.

6. The speaker device according to claim 1, wherein the acoustic diaphragm includes a plurality of acoustic diaphragms, and wherein the vibration transfer member contacts the plurality of acoustic diaphragms.

7. The speaker device according to claim 1, wherein the acoustic diaphragm includes a plurality of acoustic diaphragms, and wherein the vibration transfer member includes a plurality of vibration transfer members, such that each of the plurality of acoustic diaphragms is associated with one of the plurality of vibration transfer members.

8. The speaker device according to claim 6, wherein the plurality of acoustic diaphragms include acoustic diaphragms having different materials, respectively.

9. The speaker device according to claim 1, wherein the vibration transfer member includes a vibration transfer member for a left-audio channel contacting a left side of the acoustic diaphragm and a vibration transfer member for a right-audio channel contacting a right side of the acoustic diaphragm, and wherein the actuator includes an actuator for the left-audio channel adding vibration to the vibration transfer member for the left-audio channel in accordance with an audio signal of the left-audio channel and an actuator for the right-audio channel adding vibration to the vibration transfer member for the right-audio channel in accordance with an audio signal of the right-audio channel.

10. The speaker device according to claim 1, wherein a shape of the acoustic diaphragm is a plate shape, a cylindrical shape, or other three-dimensional shape.

11. The speaker device according to claim 7, wherein the plurality of acoustic diaphragms include acoustic diaphragms having different materials.

12. The speaker device according to claim 1, wherein the actuator includes a drive rod that moves upward and downward so as to tap an end of the vibration transfer member.

13. The speaker device according to claim 1, wherein the vibration transfer member is embedded in the acoustic diaphragm.

14. The speaker device according to claim 1, wherein the vibration transfer member is in contact with the surface of the acoustic diaphragm.

15. The speaker device according to claim 1, wherein the predetermined length of the vibration transfer member depends on material properties of the vibration transfer member including internal vibration propagation loss and sound velocity.

16. The speaker device according to claim 1, wherein the actuator is mounted in the diaphragm.

17. The speaker device according to claim 1, wherein a shape of a cross-section of the vibration transfer member is polygonal.

18. The speaker device according to claim 1, wherein a material of the vibration transfer member has a lower internal vibration propagation loss and a higher sound velocity than an internal vibration propagation loss and a sound velocity of a material of the acoustic diaphragm.

19. The speaker device according to claim 1, wherein a shape of a cross-section of the vibration transfer member, taken along the longitudinal direction of the vibration transfer member, remains constant throughout a length of the vibration transfer member.

* * * * *